US010393477B1

(12) United States Patent
Kincaid et al.

(10) Patent No.: US 10,393,477 B1
(45) Date of Patent: Aug. 27, 2019

(54) RETENTION HOLSTER FOR A FIREARM HAVING AN OFFSET MOUNTED ACCESSORY

(71) Applicant: Vista Outdoor Operations LLC, Anoka, MN (US)

(72) Inventors: Robert A. Kincaid, Manhattan, MT (US); Thomas M. Gregory, Belgrade, MT (US); Birten L. Todd, Harrison, MT (US); Eric M. Yeates, Virginia Beach, VA (US); Clifton L. Cook, Boise, ID (US); Thomas A. Marx, Virginia Beach, VA (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

(21) Appl. No.: 15/821,478

(22) Filed: Nov. 22, 2017

Related U.S. Application Data

(63) Continuation of application No. 14/229,900, filed on Mar. 29, 2014, now abandoned, which is a (Continued)

(51) Int. Cl.
*F41C 33/02* (2006.01)

(52) U.S. Cl.
CPC ..... *F41C 33/02* (2013.01); *F41C 33/0263* (2013.01)

(58) Field of Classification Search
CPC ... F41C 33/02; F41C 33/0263; F41C 33/0254
See application file for complete search history.

(56) References Cited

U.S. PATENT DOCUMENTS 1,046,912 A 12/1912 Wanee
1,113,530 A 10/1914 Audley
(Continued)

FOREIGN PATENT DOCUMENTS

EP 1975542 A2 10/2008
FR 2893404 A1 5/2007
(Continued)

OTHER PUBLICATIONS

European Patent Office, Search Opinion of Application No. 10828676.6, dated Feb. 16, 2015 3 pages.
(Continued)

*Primary Examiner* — Derek J Battisti
(74) *Attorney, Agent, or Firm* — Christensen, Fonder, Dardi & Herbert PLLC

(57) ABSTRACT

A holster for accommodating a handgun having an attached, offset accessory, including walls defining a cavity for receiving the handgun and the attached accessory, a retention means that is capable of retaining a handgun and accessory in the holster, wherein the retention means includes a lever that is pivotally connected, via a pivot pin, to the first side wall approximately between a finger button end and an engagement end, wherein the engagement end includes a locking portion, formed on a second side of the engagement end, wherein the lever is pivotable between an engaged position and a disengaged position and wherein the lever is biased, via a spring means, to the engaged position, such that when the lever is in the engaged position, the locking portion may extend inside the cavity and inside the inner surface of the trigger guard of a handgun that is secured into the holster.

17 Claims, 10 Drawing Sheets

Related U.S. Application Data continuation of application No. 11/985,658, filed on Nov. 16, 2007, now Pat. No. 8,714,423.

(60) Provisional application No. 60/859,381, filed on Nov. 16, 2006.

(56) References Cited

U.S. PATENT DOCUMENTS 1,148,935 A 8/1915 Snavely
1,421,578 A 7/1922 Schussler
1,635,984 A 7/1927 Corriston
1,641,439 A 9/1927 Jovino
1,750,139 A 3/1930 Swift
1,851,352 A 3/1932 Denkert
1,951,865 A 3/1934 Franz
2,051,844 A 8/1936 Green
2,088,811 A 8/1937 Ray
2,109,734 A 3/1938 Preneta
2,349,376 A 5/1944 Ray
2,443,397 A 6/1948 Myres
2,551,913 A 5/1951 Toby
2,577,869 A 12/1951 Adams
2,893,615 A 7/1959 Couper
3,289,903 A 12/1966 Taormina
3,419,728 A 12/1968 Wilson
3,420,420 A 1/1969 Clark
3,550,821 A 12/1970 Daigle
3,550,822 A 12/1970 Lloyd
3,669,325 A 6/1972 Furman
3,718,240 A 2/1973 Rose
3,777,952 A 12/1973 Theodore
3,804,306 A 4/1974 Azurin
3,828,990 A 8/1974 Baldocchi
3,866,811 A 2/1975 Hamby
3,904,091 A 9/1975 Jones
3,910,469 A 10/1975 Baldocchi
RE30,139 E 11/1979 Jones
4,277,007 A 7/1981 Bianchi et al.
4,846,384 A 7/1989 Perry
5,018,654 A 5/1991 Rogers et al.
5,048,735 A 9/1991 McCormick
5,082,318 A 1/1992 Held et al.
5,094,376 A 3/1992 Baruch
5,100,036 A 3/1992 Rogers et al.
5,127,566 A 7/1992 Beletsky
5,129,562 A 7/1992 Bianchi
5,199,620 A 4/1993 Beletsky
5,215,238 A 6/1993 Baruch
5,275,317 A 1/1994 Rogers et al.
5,282,559 A 2/1994 Aerle et al.
5,284,281 A 2/1994 Nichols
5,322,200 A 6/1994 Blanchard
5,358,160 A 10/1994 Bianchi
5,372,288 A 12/1994 Rogers et al.
5,395,021 A 3/1995 Brown
5,419,474 A 5/1995 Marx et al.
5,421,497 A 6/1995 Gilmore
5,449,103 A 9/1995 Tilley
5,458,266 A 10/1995 Pichot
5,467,909 A 11/1995 Resca et al.
5,570,830 A 1/1996 Nichols
5,501,380 A 3/1996 Wu
5,501,381 A 3/1996 Rogers et al.
5,509,591 A 4/1996 Carver
5,513,785 A 5/1996 Campagna, Jr.
5,518,155 A 5/1996 Gallagher
5,551,611 A 9/1996 Gilmore
5,573,157 A 11/1996 Mauriello et al.
5,598,958 A 2/1997 Ryan, III et al.
5,611,164 A 3/1997 Rassias
5,622,295 A 4/1997 Hellweg et al.
5,749,507 A 5/1998 Wood
5,758,448 A 6/1998 Thummel
5,768,816 A 6/1998 Rassias
5,779,114 A 7/1998 Owens
5,806,739 A 9/1998 Wood
5,810,221 A 9/1998 Beletsky et al.
5,810,222 A 9/1998 Shoemaker
5,855,305 A 1/1999 Nichols
5,916,087 A 6/1999 Owens
5,918,784 A 7/1999 Serpa
5,927,578 A 7/1999 Kay
5,931,358 A 8/1999 Rogers
5,944,239 A 8/1999 Rogers et al.
5,961,013 A 10/1999 Collins
6,085,951 A 7/2000 Beletsky et al.
6,112,962 A 9/2000 Matthews
6,149,042 A 11/2000 Rassias
6,189,751 B1 2/2001 Tserng
6,230,946 B1 5/2001 Vor Keller et al.
6,267,279 B1 7/2001 Matthews
6,276,581 B1 8/2001 Glock
6,320,975 B1 11/2001 Vieweg
6,349,496 B1 2/2002 Neely
6,389,726 B1 5/2002 Bentley
6,398,089 B1 6/2002 Har-Shen
6,415,541 B1 7/2002 Rassias
6,467,660 B1 10/2002 Rogers et al.
6,523,374 B1 2/2003 Owens
6,533,149 B2 3/2003 Vor Keller et al.
6,547,111 B2 4/2003 French
6,585,209 B1 7/2003 Mattingly
6,588,635 B2 7/2003 Vor Keller et al.
6,604,657 B2 8/2003 Yirmiyahu et al.
6,616,020 B1 9/2003 Spielberger
6,634,527 B2 10/2003 Lui
6,641,009 B2 11/2003 French et al.
6,732,891 B2 5/2004 Locklear, III
6,752,300 B2 6/2004 Har-Shen
6,755,331 B2 6/2004 Rassias
6,769,581 B2 8/2004 Rogers et al.
6,769,582 B1 * 8/2004 Beletsky ..... F41C 33/0209 224/244
6,799,392 B2 10/2004 Milec et al.
D501,991 S 2/2005 Cook et al.
6,854,626 B2 2/2005 Liao
6,886,725 B2 5/2005 Lowe et al.
6,918,519 B2 7/2005 Vor Keller et al.
6,948,644 B1 9/2005 Beletsky
D512,561 S 12/2005 Cook et al.
7,117,625 B2 10/2006 Pikielny
7,134,234 B1 * 11/2006 Makarounis ..... F41G 11/004 42/146
7,140,523 B2 11/2006 Lowe et al.
7,200,965 B2 4/2007 Vor Keller et al.
7,258,259 B1 8/2007 Owens
7,434,712 B2 10/2008 Cook et al.
7,461,765 B2 12/2008 French et al.
7,530,456 B1 5/2009 Tsai
7,543,404 B2 6/2009 Kovalchuk et al.
7,556,181 B2 7/2009 Spielberger
7,562,797 B2 7/2009 Senn et al.
7,584,875 B2 9/2009 Lowe et al.
7,591,402 B2 9/2009 Rassias
7,644,845 B2 1/2010 Lowe
7,694,860 B2 4/2010 Clifton, Jr.
7,735,255 B1 6/2010 Kincaid et al.
7,762,018 B1 7/2010 Fitzpatrick et al.
7,819,294 B2 10/2010 Lowe et al.
7,841,497 B1 11/2010 Gregory et al.
7,850,053 B2 12/2010 Rassias
7,922,050 B2 4/2011 Benes
7,934,333 B1 5/2011 Tuz
7,937,880 B1 5/2011 Fidlow
7,950,553 B2 5/2011 Rassias
7,954,971 B1 6/2011 Kincaid et al.
8,052,018 B2 11/2011 Gallagher
8,096,453 B2 * 1/2012 Lowe ..... F41C 33/0209 224/243
8,132,355 B1 3/2012 Kincaid et al.
8,141,758 B2 3/2012 Spielberger
8,177,108 B1 5/2012 Kincaid et al.
8,215,525 B2 7/2012 Rassias
8,235,263 B1 8/2012 Yeates et al.

(56) References Cited

U.S. PATENT DOCUMENTS

| | | | | |
|---|---|---|---|---|
| 8,251,266 | B2 | 8/2012 | Gregory et al. | |
| 8,281,512 | B2 | 10/2012 | Lara | |
| 8,302,827 | B1 | 11/2012 | Cole | |
| 8,371,487 | B1 | 2/2013 | Plappert | |
| 8,474,670 | B1 | 7/2013 | Gregory et al. | |
| RE44,428 | E | 8/2013 | Spielberger | |
| 8,517,235 | B1 | 8/2013 | Kincaid et al. | |
| 8,544,706 | B2 | 10/2013 | Crye | |
| 8,602,275 | B1 | 12/2013 | Kiger et al. | |
| 8,602,276 | B2 | 12/2013 | Tyybakinoja | |
| 8,631,981 | B2 | 1/2014 | Zusman | |
| 8,646,665 | B2 | 2/2014 | Abushaev | |
| 8,690,032 | B2 | 4/2014 | Baumann et al. | |
| 8,714,423 | B1 | 5/2014 | Kincaid et al. | |
| 8,720,753 | B2 | 5/2014 | Benes | |
| 8,720,754 | B2 | 5/2014 | Kirsch | |
| 8,720,755 | B2 | 5/2014 | Gregory et al. | |
| 8,783,532 | B2 | 7/2014 | Gregory et al. | |
| 8,807,404 | B1 | 8/2014 | Howell et al. | |
| 8,851,344 | B2 | 10/2014 | Baumann et al. | |
| 8,870,042 | B2 | 10/2014 | Clifton | |
| 8,910,839 | B2 | 12/2014 | Clifton | |
| 8,925,773 | B2 | 1/2015 | Clifton | |
| D723,796 | S | 3/2015 | Resca | |
| 8,985,412 | B2 | 3/2015 | Rorick et al. | |
| 9,016,533 | B2 | 4/2015 | Visalli et al. | |
| 9,022,262 | B2 | 5/2015 | Pellegrini | |
| 9,057,579 | B2 | 6/2015 | Rorick et al. | |
| 9,057,580 | B2 | 6/2015 | Rorick et al. | |
| 9,086,254 | B1 | 7/2015 | Plappert | |
| 9,109,855 | B1 | 8/2015 | Kincel | |
| 9,134,093 | B2 | 9/2015 | Yeates | |
| D740,021 | S | 10/2015 | Faifer | |
| 9,175,925 | B2 | 11/2015 | Pellegrini | |
| 9,228,802 | B2 | 1/2016 | Ribas | |
| 2004/0050887 | A1 | 3/2004 | Spielberger | |
| 2004/0195282 | A1* | 10/2004 | Beletsky | F41C 33/0209 224/244 |
| 2005/0205621 | A1 | 9/2005 | Shults | |
| 2005/0205624 | A1 | 9/2005 | French et al. | |
| 2005/0279789 | A1 | 12/2005 | Lowe | |
| 2005/0279790 | A1 | 12/2005 | Lowe | |
| 2006/0011680 | A1 | 1/2006 | Cook et al. | |
| 2006/0156525 | A1 | 7/2006 | Jenkins et al. | |
| 2006/0157520 | A1 | 7/2006 | Clifton, Jr. | |
| 2006/0175366 | A1 | 8/2006 | Dekaise | |
| 2006/0226185 | A1 | 10/2006 | Har-Shen | |
| 2007/0181619 | A1 | 8/2007 | Seyfert et al. | |
| 2007/0194067 | A1 | 8/2007 | Lowe et al. | |
| 2008/0110947 | A1 | 5/2008 | Pikielny | |
| 2008/0121670 | A1 | 5/2008 | Buress | |
| 2008/0179359 | A1 | 7/2008 | Aberle et al. | |
| 2008/0179360 | A1 | 7/2008 | Lowe et al. | |
| 2009/0224014 | A1 | 9/2009 | Kumuchian | |
| 2009/0321480 | A1 | 12/2009 | Kincaid et al. | |
| 2010/0276464 | A1 | 11/2010 | Hirt et al. | |
| 2011/0011904 | A1 | 1/2011 | Schultz et al. | |
| 2011/0101063 | A1 | 5/2011 | Zusman | |
| 2011/0163138 | A1 | 7/2011 | Tybakinoja | |
| 2011/0174849 | A1 | 7/2011 | Clifton, Jr. | |
| 2011/0174850 | A1 | 7/2011 | Clifton, Jr. | |
| 2013/0240582 | A1 | 9/2013 | Tyybakinoja et al. | |
| 2014/0048572 | A1 | 2/2014 | Yeates | |
| 2014/0109345 | A1 | 4/2014 | Melville | |
| 2015/0285587 | A1 | 10/2015 | Abushaev | |
| 2017/0003101 | A1 | 1/2017 | Madrid et al. | |

FOREIGN PATENT DOCUMENTS

| | | |
|---|---|---|
| WO | WO2010/064268 | 6/2010 |
| WO | WO2013/071402 | 5/2013 |
| WO | WO2014/028876 | 2/2014 |
| ZA | 986778 | 2/1999 |

OTHER PUBLICATIONS

European Patent Office, Supplementary Search Report of Application No. 10828676.6, dated Feb. 16, 2015 2 pages.

Written Opinion of the International Searching Authority for International Application No. PCT/US2010/002935 dated Jan. 7, 2011.

PCT International Preliminary Report on Patentability for International Application No. PCT/US2010/002935 dated May 15, 2012 5 pages.

PCT International Search Report for International Application No. PCT/US2010/002935 dated Jan. 7, 2011, 2 pages.

* cited by examiner

RETENTION HOLSTER FOR A FIREARM HAVING AN OFFSET MOUNTED ACCESSORY

CROSS-REFERENCE TO RELATED APPLICATIONS

This application is a continuation of U.S. patent application Ser. No. 14/229,900, filed Mar. 29, 2014, which is a continuation of U.S. application Ser. No. 11/985,658, filed Nov. 16, 2007, now U.S. Pat. No. 8,714,423, issued May 6, 2014, which claims the benefit of U.S. Provisional Patent Application No. 60/859,381, filed Nov. 16, 2006, the disclosures of which are incorporated herein by reference.

BACKGROUND OF THE INVENTION

1. Field of the Invention

The present invention is directed generally to an offset mountable light, an accessory mounting clamp, and a retention holster for a firearm with a mounted accessory. More specifically, the present invention is directed to an offset mountable light that, when installed on a handgun, allows access to at least a portion of the handgun's trigger guard, an adjustable accessory mounting clamp, and a retention holster that is capable of accommodating and securing a handgun having an installed light or other mounted accessory.

2. Description of Related Art

A large variety of accessories have been developed, which may be mounted to a handgun, rifle, carbine, submachine gun, shotgun, or other firearm, tool, or device. Accessories, such as lights, lasers, or other target illuminators, fire control devices, sights, scopes, night vision devices, mounts, handgrips, bipods, and other specially designed accessories have been developed to be mounted to a variety of firearms, tools, or devices via an accessory mount, such as, for example, a Picatinny rail.

The Picatinny rail is a generally wedge shaped, or dovetailed feature used on some firearms, tools, or other devices in order to provide a standardized accessory mounting platform. The standard for the Picatinny rail was first published by the Picatinny Arsenal in 1913, and thus carries the official U.S. Government designation MIL-STD-1913.

The inclusion of a Picatinny or other proprietary or nonproprietary rails on firearms has become quite common and accessory rails are now offered on virtually every type of firearm, from rifles, to shotguns, to handguns. Various lengths of accessory rails are also available to be coupled to firearms in various locations, and in some cases, firearms grips or forearms are available with accessory rails included on all sides.

Using an accessory rail system, a given accessory may be mounted to a variety of firearms or firearms platforms. Likewise, if a particular firearm includes an accessory rail, a variety of accessories may be interchangeably mounted to the firearm.

The interchangeability of accessories is of particular importance to military and law enforcement personnel attached to special operations units, as this allows a single firearm to be reconfigured to meet certain mission specific needs.

One accessory that is becoming rather ubiquitous is a handgun mounted light. Present handgun mounted lights typically attach to a Picatinny or other similar dovetail-type accessory rail formed or mounted on the dust cover portion of the frame of the handgun forward of the trigger guard. These handgun mounted lights are centered along the bore axis of the handgun.

SUMMARY OF TIE INVENTION

However, because current handgun mounted lights are designed to be mounted so that they are centered along the central bore axis of the handgun, the current handgun mounted lights block or obstruct access to the handgun's trigger guard such that handguns with mounted lights cannot work in conjunction with retention holsters that operate to retain the handgun by operation of a retention means or active retention system that locks on at least a portion of the trigger guard.

Furthermore, the rail mating portions, or "claws", of the current handgun mounted lights or accessories are typically made to accommodate one particular type of accessory rail and require an adapter to work with more than one type of accessory rail.

This invention relates generally to an offset mountable light, an accessory mounting clamp, and a retention holster for a firearm with a mounted accessory. More specifically, the present invention is directed to an offset mountable light that, when installed on a handgun, is offset from the central bore axis of the handgun to allow access to at least a portion of the handgun's trigger guard, an adjustable accessory mounting clamp, and a retention holster that is capable of accommodating and securing a handgun having an installed light or other mounted accessory.

Accordingly, this invention provides an offset mountable light, that can be installed on a handgun and still allow access to at least a portion of the handgun's trigger guard.

This invention separately provides an offset mountable light is installed on a handgun such that the light is offset from the central bore axis of the handgun.

This invention separately provides an adjustable accessory mounting clamp, which provides a simple and reliable quick-release mounting system for any rail-compatible accessory.

This invention separately provides an adjustable accessory mounting clamp, which provides an improved accessory mounting system that can be used with a variety of optional accessories so that the accessories may be quickly, easily, and firmly secured, and then quickly and easily removed from an accessory rail.

This invention separately provides a retention holster, which is capable of accommodating and securing a handgun having an installed light or other mounted accessory.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

For simplicity and clarification, the design factors and operating principles of the offset mountable light, the adjustable accessory mounting clamp, and the accommodating retention holster according to this invention are explained with reference to various exemplary embodiments of an offset mountable light, an adjustable accessory mounting clamp, and an accommodating retention holster. The basic explanation of the design factors and operating principles of the offset mountable light, the adjustable accessory mounting clamp, and the accommodating retention holster is applicable for the understanding, design, and operation of the offset mountable light, the adjustable accessory mounting clamp, and the accommodating retention holster of this invention.

Furthermore, it should be appreciated that, for simplicity and clarification, the embodiments of this invention will be described with reference to the offset mountable light being mounted to a semiautomatic-type handgun. However, it should be appreciated that the operating principles of the offset mountable light of this invention may also be employed to mount the offset mountable light to any functional, nonfunctional, or replica handgun, long gun, edged weapon, less than lethal product (i.e., a taser, pepper spray, mace canister, baton, or the like), or other device or tool, so long as the item has an appropriate dovetail-type accessory mounting portion.

Likewise, it should be appreciated that, for simplicity and clarification, the embodiments of this invention will be described with reference to the adjustable accessory mounting clamp being included as a part of an offset mountable light. However, it should be appreciated that the operating principles of the adjustable accessory mounting clamp of this invention may also be employed to mount other accessories to any functional, nonfunctional, or replica handgun, long gun, edged weapon, less than lethal product (i.e., a taser, pepper spray, mace canister, baton, or the like), or other device or tool, so long as the item has an appropriate dovetail-type accessory mounting portion.

It should also be appreciated that the terms "handgun", "handgun holster", and "firearm" are used for basic explanation and understanding of the operation of the systems, methods, and apparatuses of this invention. Therefore, the terms "handgun", "handgun holster", and "firearm" are not to be construed as limiting the systems, methods, apparatuses, or applications of this invention.

Light Accessory

Figure 1:
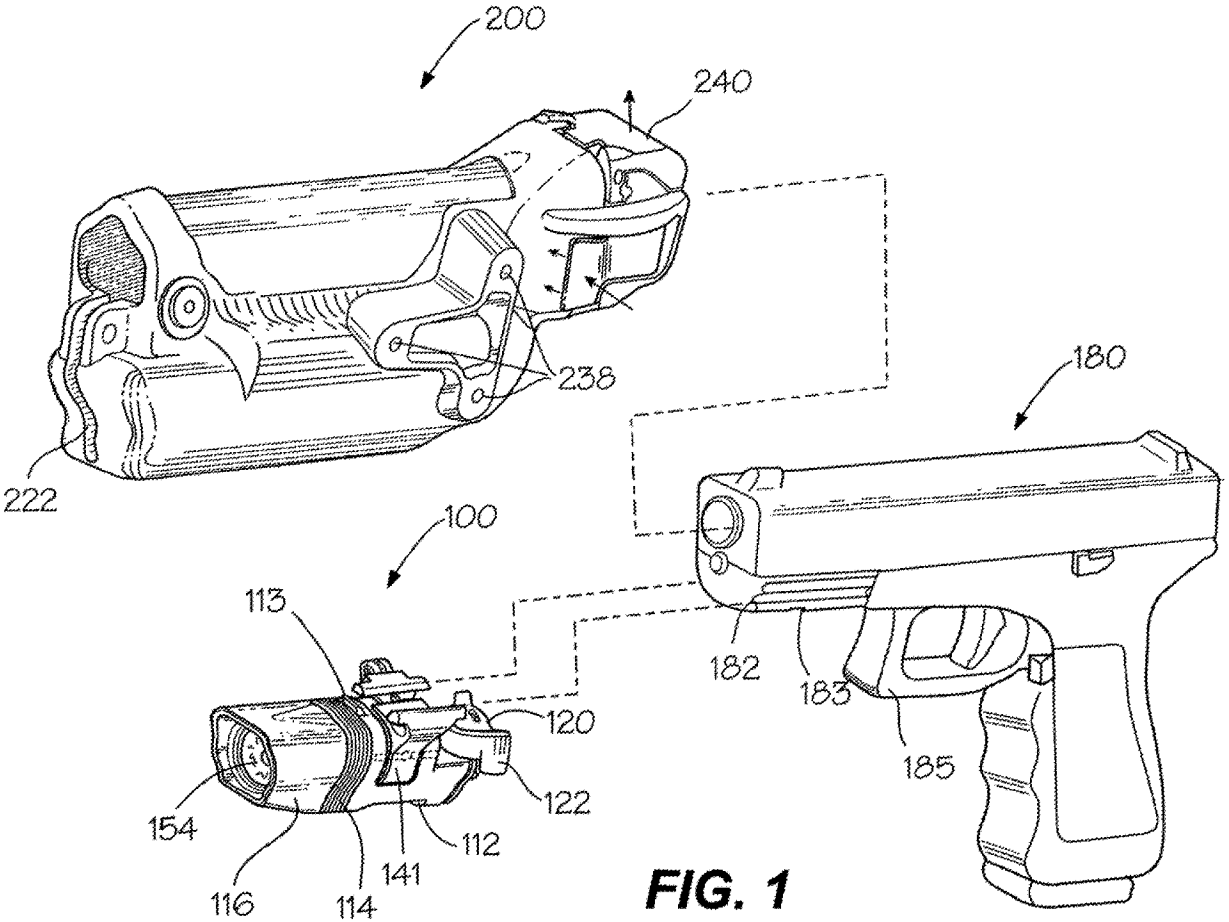
FIG. 1 shows a left side perspective view of a first exemplary embodiment of an offset mountable light having an adjustable accessory mounting clamp, an exemplary handgun, and a retention holster that is capable of accommodating and securing the handgun with the installed light, according to this invention.

Turning now to the drawing Figs., FIG. 1 shows a left side perspective view of a first exemplary embodiment of an offset mountable light 100 having an adjustable accessory mounting clamp 140 (shown in greater detail in FIGS. 2A and 2B), an exemplary handgun 180, and a retention holster 200, which is capable of accommodating and securing the handgun 180 with or without the installed light 100, according to this invention.

It should be appreciated that the exemplary handgun 180, as illustrated herein, is intended to represent a typical semiautomatic-type handgun. Generally, semiautomatic-type handguns include a slide and a frame and have a muzzle end and a hammer/firing pin end. The frame generally includes a grip, a trigger guard 185, and a trigger. The trigger guard 185 includes an inner surface, which defines an area within which the trigger is located and which allows a user's finger access to the trigger, and an outer surface, which defines the outer perimeter of the trigger guard. Many handguns also include an accessory mounting rail 182, having one or more anti-recoil grooves 183. Typically, the accessory mounting rail 182 comprises a Picatinny or other similar Proprietary or nonproprietary rail.

Figure 2A:
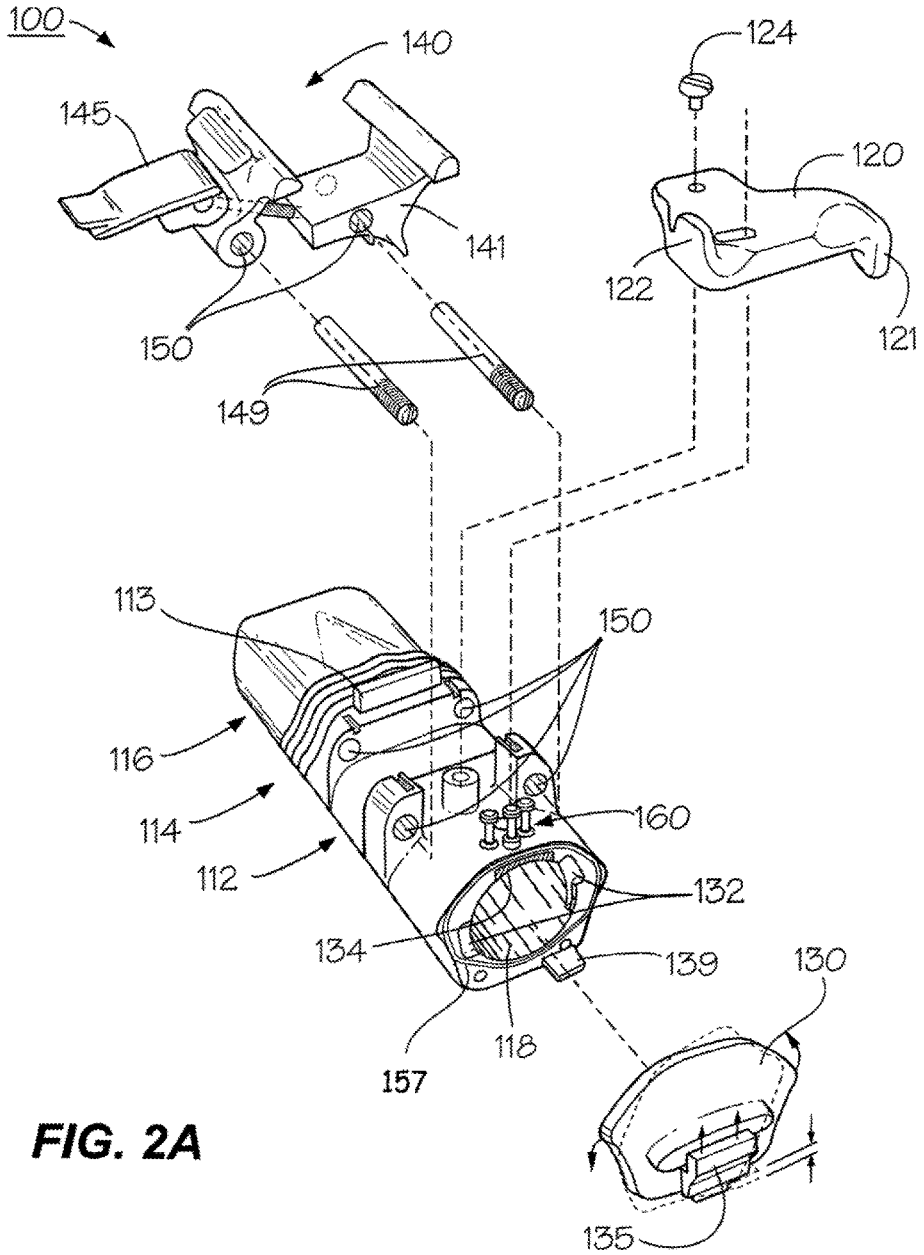
FIG. 2A shows a partial exploded rear elevation view of a first exemplary embodiment of an offset mountable light having an adjustable accessory mounting clamp according to this invention, illustrating the mountable light assembly for a left side application.

FIG. 2A shows a partial exploded rear elevation view of a first exemplary embodiment of an offset mountable light 100 having an adjustable accessory mounting clamp 140 according to this invention, illustrating the mountable light assembly for a left side application. As shown in FIG. 2A, an offset mountable light 100 includes at least some of a light body 112, an optional heat sink element 114, and a light hood 116.

In various exemplary embodiments, the light hood 116 is formed so as to protrude from the lens 154 and reduce the amount of debris that is deposited on the lens 154 when the offset mountable light 100 is used during live fire. It should be appreciated that the overall size and shape of the light hood 116 is a design choice based upon the desired appearance and functionality of the light hood 116.

In various exemplary embodiments, the light hood 116 is formed so as to accept scope cover type filters, quick on/off type filter or lens cover systems, or allow for replacement of the lens 154.

The optional heat sink element 114, if included, is formed so as to draw heat away from the interior of the offset mountable light 100 to be dissipated from the surface of the offset mountable light 100. The optional heat sink element 114 may comprise ribbing, fins, fluting, or some other surface preparation or treatment to assist in heat transfer and/or heat dissipation. Likewise, the optional heat sink element 114 may be formed of a material that is specifically selected to optimize heat transfer and/or heat dissipation.

Figure 2B:
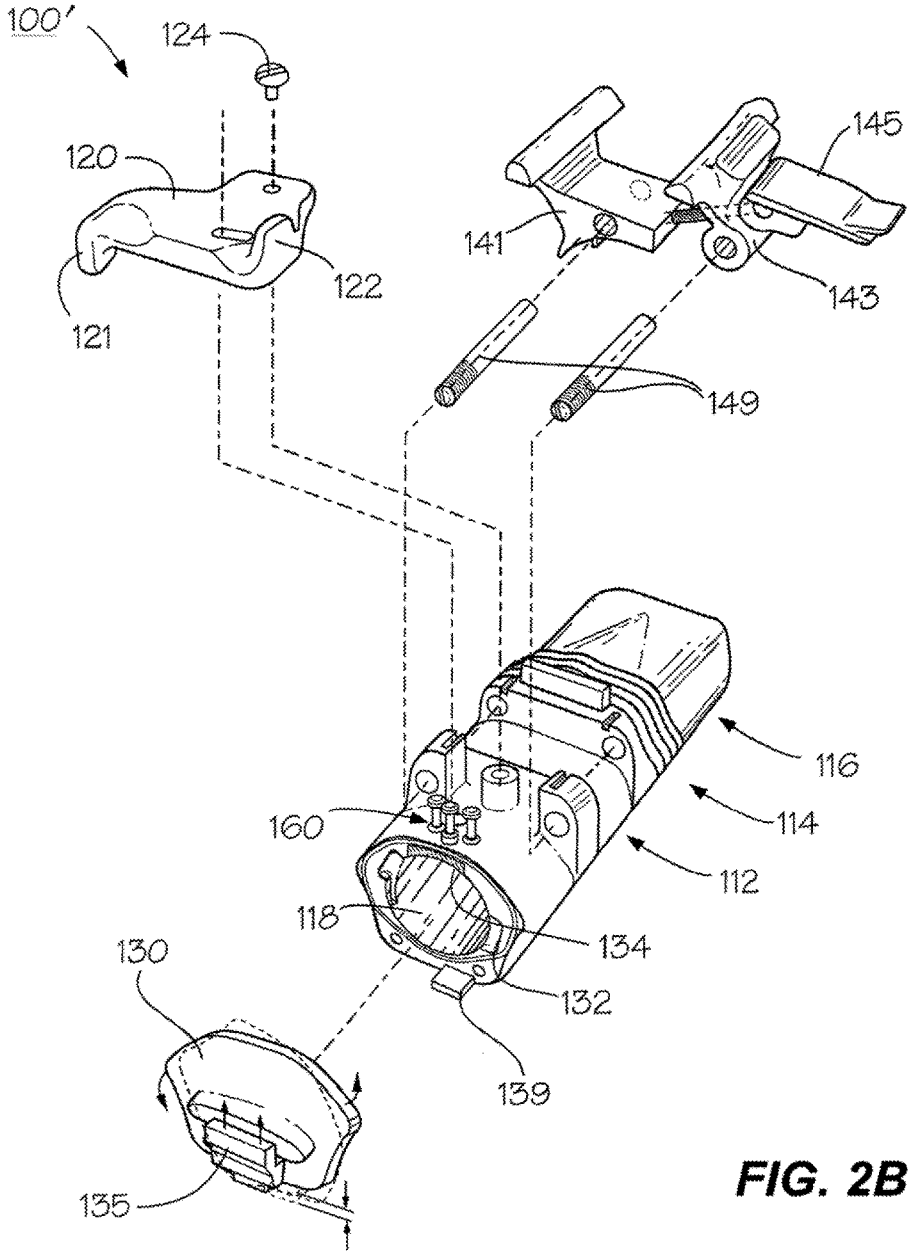
FIG. 2B shows a partial exploded rear elevation view of a first exemplary embodiment of an offset mountable light having an adjustable accessory mounting clamp according to this invention, illustrating the mountable light assembly for a right side application.
Figure 7A:
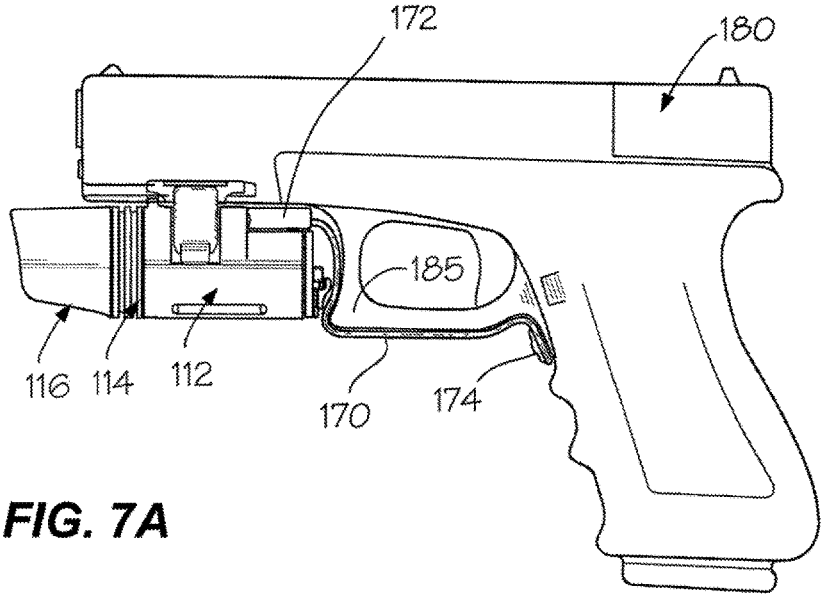
FIG. 7A shows a left side elevation view of a first exemplary embodiment of an offset mountable light mounted to an exemplary handgun, wherein the switch bar has been replaced by a first exemplary embodiment of an optional pressure-activated switch, or pressure pad tape switch, which extends under the handgun trigger guard, according to this invention.
Figure 7B:
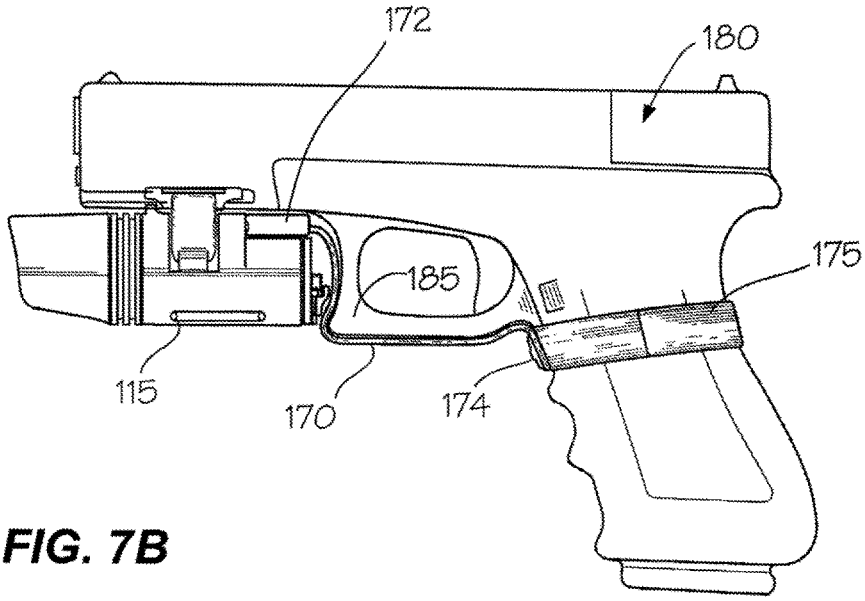
FIG. 7B shows a left side elevation view of a first exemplary embodiment of an offset mountable light mounted to an exemplary handgun, wherein the switch bar has been replaced by a second exemplary embodiment of an optional pressure-activated switch, or pressure pad tape switch, which extends under the handgun trigger guard, according to this invention.

In various exemplary embodiments, the light body 112, the optional heat sink element 114, and the light hood 116 are assembled or coupled together as illustrated in FIGS. 1, 2A, 2B. 7A, and 7B, via a light body coupling means 115 comprising a screw (as partially illustrated in FIG. 7B). However, it should be appreciated that, in various exemplary embodiments, the light body 112, the optional heat sink element 114, and the light hood 116 may be threadedly attached or coupled via screws, threaded pins, friction fit pins, rivets, mating internal and external threads, or a series of corresponding snap detents and flanges. Alternatively, two or more of the light body 112, the optional heat sink element 114, and the light hood 116 may be formed as one integral unit.

In various exemplary embodiments, one or more optional, appropriately sized O-rings (not shown) may be included between certain of the light body 112, the optional heat sink element 114, and the light hood 116. In this manner, a watertight or water resistant seal and/or a level of shock isolation may be created between the light body 112, the optional heat sink element 114, and the light hood 116, when these elements are attached or coupled together.

In various exemplary embodiments (as further illustrated in FIGS. 3A and 3B), the light hood 116 comprises at least some of a reflector 156, a light source 152, and a lens 154. One or more optional, appropriately sized O-rings (not shown) may be included between certain of the components of the light hood 116. In this manner, a watertight or water resistant seal and/or a level of shock isolation may be created between, for example, the reflector 156 and the lens 154.

In various exemplary embodiments, the reflector 156 comprises a polymer optic or a conventional (type) reflector as a means of driving light from the light source 152 forward. It should be appreciated that any known or later developed reflector, which is capable of focusing and/or deflecting the generated light may be used as a reflector 156.

In various exemplary embodiments, the light source 152 comprises a LED. Alternatively, the light source 152 may comprise an incandescent, infrared, laser, or other known or later developed visible or non-visible wavelength illumination device. In various other exemplary embodiments, the light source 152 may comprise a combination of one or more LEDs, incandescent, infrared, laser, or other known or later developed visible or non-visible wavelength illumination devices.

As illustrated in FIGS. 2A and 2B, a battery compartment 118 is positioned within a cavity formed by the light body 112. The battery compartment 118 is formed so as to allow one or more batteries to be housed within the battery compartment 118.

Figure 5A:
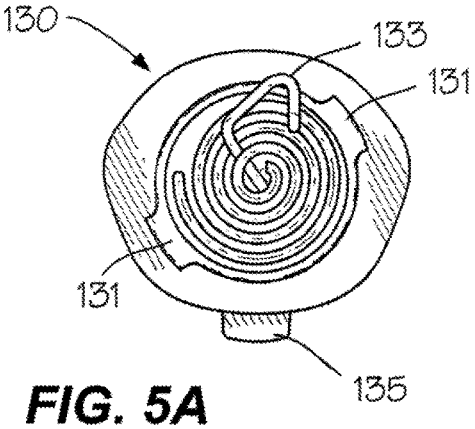
FIG. 5A shows a rear elevation view of a first exemplary embodiment of a locking battery cover according to this invention.
Figure 5B:
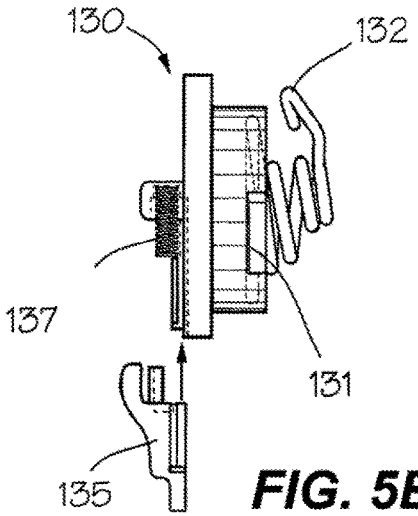
FIG. 5B shows a partial exploded side elevation view of a first exemplary embodiment of a locking battery cover according to this invention.

As illustrated in FIGS. 2A and 2B, and in greater detail in FIGS. 5A and 5B, the offset mountable light 100 includes a locking battery cover 130. In various exemplary embodiments, the locking battery cover 130 is shaped so as to be rotatably secured to the light body 112 so as to cover the battery compartment 118 and provide electrical connection between a battery housed within the battery compartment 118 and the remaining circuitry of the offset mountable light 100.

The locking battery cover 130 is formed so as to include one or more locking tabs 131. The locking tabs 131 are formed so as to be compatible with corresponding battery cover locking recesses 132 formed in the light body 112. In order to secure the locking battery cover 130 to the light body 112, the locking tabs 131 are aligned with the corresponding battery cover locking recesses 132, the locking battery cover 130 is urged against an end of the light body 112, and the locking battery cover 130 is rotated so that the locking tabs 131 are directed past the battery cover locking recesses 132 and are held within a channel (not shown) formed in the light body 112.

In certain exemplary embodiments, one or more optional, appropriately sized O-ring 156 may be included between the locking battery cover 130 and the light body 112. In this manner, a watertight or water resistant seal and/or a level of shock isolation may be created between the locking battery cover 130 and the light body 112. While the O-ring 156 is shown as being held within a recess of the light body 112, it should be appreciated that the O-ring 156, or an alternative O-ring, may be held within a recess of the locking battery cover 130.

Figure 5C:
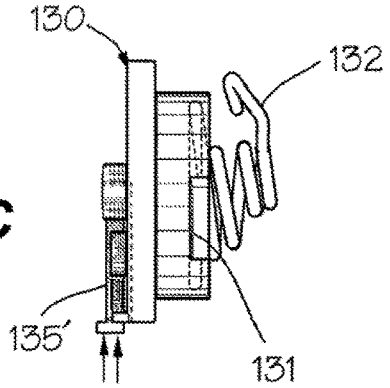
FIG. 5C shows a partial exploded side elevation view of a second exemplary embodiment of a locking battery cover according to this invention.
Figure 5D:
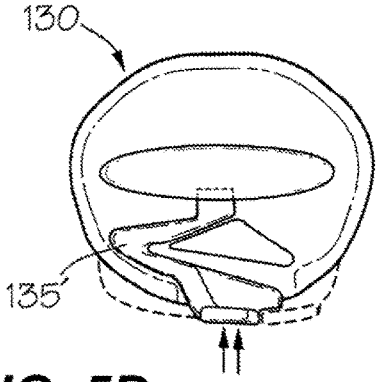
FIG. 5D shows a front elevation view of a second exemplary embodiment of a locking battery cover in a locked position according to this invention.
Figure 5E:
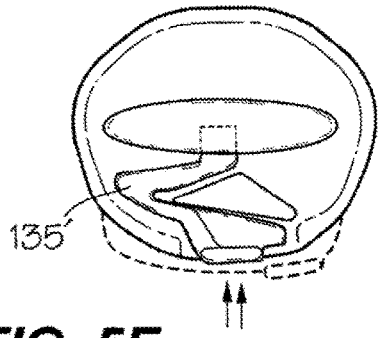
FIG. 5E shows a front elevation view of a second exemplary embodiment of a locking battery cover in an unlocked position according to this invention.

In various exemplary embodiments, the locking battery cover 130 includes a spring biased battery cover lock 135. In certain exemplary embodiments (as illustrated in FIGS. 5C-5D), the battery cover lock 135' is formed so as to provide a natural bias without requiring the inclusion of the spring or any other additional spring.

The battery cover lock 135 is secured to the locking battery cover 130 so as to be movable between a locking and an unlocking position. In certain exemplary embodiments, the battery cover lock 135 is spring biased, by spring means 137, to the locking position so that when the locking battery cover 130 is secured to the light body 112, via the interaction of the locking tabs 131 and the channel formed in the light body 112, the battery cover lock 135 extends so as to make contact with a battery cover locking flange 139 of the light body 112 and prevent rotation of the locking battery cover of 130.

To remove the locking battery cover 130 from the light body 112, the spring or natural bias of the battery cover lock 135 is overcome and the battery cover lock 135 is urged into an unlocking position wherein contact between the battery cover lock 135 and the battery cover locking flange 139 is avoided. Once the battery cover lock 135 is urged into the unlocking position, the locking battery cover 130 can be rotated for removal from the light body 112.

In various exemplary embodiments, the locking battery cover 130 may be replaced by a threaded battery cover (not shown) that is secured to the light body 112 by cooperating threads (not shown) formed in the light body 112 and threaded battery cover. The threaded battery cover, if included, may include a knurled portion that allows a threaded battery cover to be gripped for removal or replacement. Alternatively, the threaded battery cover may include a slot or groove formed so as to allow the battery cover to be removed or replaced using either a specialized or a readily available tool.

When an appropriate battery, or other voltage source, is contained within the battery compartment 118, a first terminal, or end, of the battery (typically the positive end) contacts an electrical contact (not shown) located within the battery compartment 118. When the locking battery cover 130 is secured to the light body 112, a second terminal, or end, of the battery (typically the negative end) contacts a battery contact 132 secured to the locking battery cover 130. The battery contact 132 is electrically connected to a battery cover contact 133, which makes electrical contact with an appropriate light body contact 134 when the locking battery cover 130 is secured to the light body 112.

Although not illustrated, the electrical contact located within the battery compartment 118 is electrically coupled to the light source 152, via a controller (not shown). Additionally, the light body contact 134 is electrically coupled to the light source 152, via the controller. Thus, both the positive and negative contacts of an appropriately installed battery, or other voltage source, are electrically coupled to the light source 152, via the controller.

In various exemplary embodiments, the controller comprises an integrated circuit that functions as an electrical control switch for the offset mountable light 100. The controller is electrically coupled to the at least two electrical contacts 160. As illustrated in FIGS. 2A and 2B, the offset mountable light 100 includes three electrical contacts 160, an inner contact 164, and two outer contacts 165. While the inner contact 164 and the two outer contacts 165 are shown as contact posts, it should be appreciated that the number and type of electrical contacts, points, and/or surfaces that serve as the electrical contacts 160 is a design choice based on the desired functionality of the offset mountable light 100.

When electrical contact is made between at least two of the electrical contacts 160, the controller controls the light source 152 to illuminate in a predetermined manner, as described below.

As also illustrated in FIGS. 2A and 2B (and in greater detail in FIGS. 5A and 5B), the offset mountable light 100 includes a light switch bar 120. The light switch bar 120 is formed so as to be pivotably coupled to the light body 112, via a light switch bar coupling means 124. In various exemplary embodiments, the light switch bar 120 is pivotably coupled to the light body 112, via a screw securing the light switch bar 122 the light body 112. The light switch bar 120 may be pivotably coupled to the light body 112, via any known or later developed means for securing the light switch bar 120 the light body 112 that allow the light switch bar 120 to be pivoted or flexed from a naturally biased center position to a switch activation position. Alternatively, light switch bar 120 may be formed as an integral part of the light body 112 provided that the light switch bar 120 is formed so as to be flexed from a naturally biased center position to a switch activation position.

As illustrated herein, the light switch bar 120 comprises an elongate piece of material having a first thumb/finger button portion 121 and a second thumb/finger button portion 122. When the light switch bar 120 is coupled to the light body 112, the first thumb/finger button portion 121 and the second thumb/finger button portion 122 are positioned so as to be reachable by a users thumb or index finger when the offset mountable light 100 is mounted on a firearm.

The first thumb/finger button portion 121 and the second thumb/finger button portion 122 are also formed such that when the offset mountable light 100 is mounted on a firearm the first thumb/finger button portion 121 and the second thumb/finger button portion 122 do not extend substantially beyond the offset mountable light 100 or the body of the handgun 180. In this manner, if the handgun 180 is placed on a surface, such as, for example, a table, the first thumb/finger button portion 121 and the second thumb/finger button portion 122 will not make contact with the surface and therefore do not inadvertently activate the offset mountable light 100.

In various exemplary embodiments, the light switch bar 120 is formed so as to be reversible and thereby usable in either a left side configuration or a right side configuration. In certain exemplary embodiments, a light switch bar 120 is formed so that it can be "flipped" for right or left side applications. Alternatively, the offset mountable light 100 may be provided with interchangeable right-hand and left-hand light switch bars (not shown).

Figure 4A:
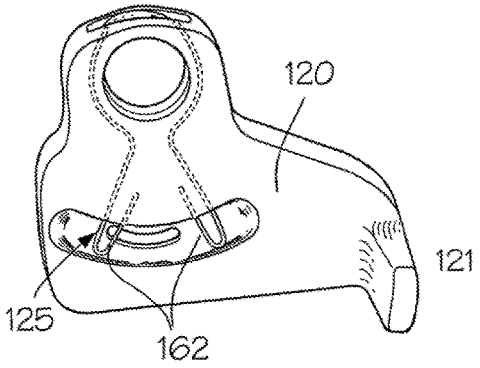
FIG. 4A shows a more detailed bottom perspective view of the switch bar of the first exemplary embodiment of the offset mountable light according to this invention.
Figure 4B:
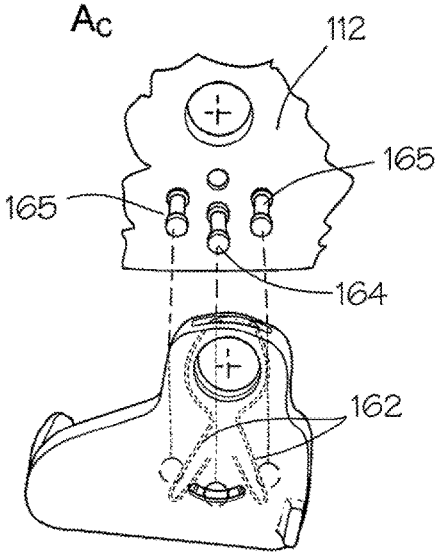
FIG. 4B shows a partial exploded top perspective view of the switch bar of the first exemplary embodiment of the offset mountable light illustrating the switch bar's relationship to the electrical contacts according to this invention.

As illustrated in FIGS. 4A and 4B, light switch bar 120 includes at least one electrical contact means 162. In various exemplary embodiments, the electrical contact means 162 may be at least partially seated within an electrical contact receiving portion 125.

As illustrated, the electrical contact means 162 may comprise an electrically conductive, spring-biased material formed so as to include two arms, each of which is naturally biased to make contact with one of the outer contacts 165 when the light switch bar 120 is coupled to the light body 112 and the light switch bar 120 is in the center position, thereby maintaining the light switch bar 120 in a center position. When the light switch bar 120 is pivoted or flexed from the naturally biased or spring biased center position to a switch activation position (flexed or pivoted to either the right or the left of the center position by being, for example, "pushed" forward, towards a light hood 116, or "pressed" inward, towards the center of the light body 112), one of the arms of the electrical contact means 162 continues to make electrical contact with one of the outer contacts 165, while the bias of the electrical contact means 162 is overcome and the other arm makes electrical contact with the inner contact 164.

It should be appreciated that the light switch bar 120 may be "pushed" forward, towards a light hood 116, or "pressed" inward, towards the center of the light body 112, by either the first thumb/finger button portion 121 or the second thumb/finger button portion 122. It should also be appreciated that the horizontal motion of "pushing" the light switch bar 120 forward or "pressing" the light switch bar 120 inward produces the same effect. Thus, the motion of "pushing" the light switch bar 120 forward or "pressing" the light switch bar 120 inward are identical on both sides of the handgun 185, making the offset mountable light 100 easier or less confusing for the user to operate than prior art firearms mounted lights.

When electrical contact is made between one of the outer contacts 165 and the inner contact 164, the controller controls the light source 152 to illuminate in a predetermined manner. In this manner, various output patterns and on/off functions of the light source 152 may be driven and/or controlled by the controller.

For example, while consistent electrical contact is made between an outer contact 165 and the inner contact 164 (i.e., the light switch bar 120 is held in a switch activation position) the controller may control the light source 152 to remain illuminated while the constant electrical contact is maintained. If, for example, short, temporary electrical contact is made between an outer contact 165 and the inner contact 164 (i.e., the light switch bar 120 is tapped into a switch activation position and quickly released) the controller may control the light source 152 to remain illuminated until temporary electrical contact is made again (i.e., the light switch bar 120 is again tapped into a switch activation position and quickly released).

If, for example, two or more short, temporary electrical contacts are made between an outer contact 165 and the inner contact 164 (i.e., the light switch bar 120 is tapped into a switch activation position and quickly released a requisite number of times) the controller may control the light source 152 to strobe until temporary electrical contact is made again (i.e., the light switch bar 120 is again tapped into a switch activation position and quickly released).

In various exemplary embodiments, the light switch bar 120 may be replaced with one more pressure pads (not shown) installed directly on to the light body 112 or the locking battery cover 130.

The pressure pad(s), if included, make appropriate contact with the electrical contacts 160 (or similar appropriate contacts) such that depression of the pressure pad(s) can act to activate the controller to illuminate the light source 152, as described herein.

In various exemplary, non-limiting embodiments, the controller comprises a high current MOSFET that functions as a microprocessor-controlled switch. The controller may be pre-programmed at the chip production level.

In certain exemplary embodiments, the controller may be situated within a cavity formed in the light body 112, the optional heat sink element 114, and/or the light hood 116.

In various exemplary embodiments, the controller may be programmed and/or reprogrammed based on the specific functions and/or modes desired by the user. Thus, the specific functions, channels, and/or modes of the offset mountable light 100 may be established and/or altered by, for example, the user, the manufacturer, or a reseller.

In various exemplary embodiments, the controller may be programmed and/or reprogrammed via a direct or indirect linked connection to a programming and/or reprogramming device. For example, one or more plugs and/or contact points (not shown) may be electrically coupled to the controller, such that the controller may be coupled, via one or more corresponding plugs and/or contact points, to a programming and/or reprogramming device.

However, it should be appreciated that the linked connection can be any known or later developed device or system for connecting the controller to a programming and/or reprogramming device, including a direct wired connection, a connection over a cellular telephone network, a very high frequency (VHF) connection, an ultra high frequency (UHF) connection, a radio frequency (RF) connection, a Bluetooth connection, a satellite connection, or the like. In general, the linked connection can be any known or later developed connection system or structure usable to connect a programming and/or reprogramming device to the controller, including both wired and wireless connections.

The controller may, for example, be programmed to illuminate the light source 152 at a particular light level. The light level may be set at any desired level. In various exemplary embodiments, the controller may allow a user to control the light level by manipulation of the light switch bar 120, as described above.

The controller may also be programmed to illuminate the light source 152 in an on/off, or strobe, mode. In various exemplary embodiments, the controller may strobe the light source 152 at a rate of greater than 0 to 60 Hz. In other exemplary embodiments, the controller may strobe the light source 152 at a rate of greater than 0 to 30 Hz. In still other exemplary embodiments, the controller may strobe the light source 152 at a rate of about 8 to 20 Hz.

The particular available illumination levels, a speed at which the illumination level changes, and/or a strobe rate may be predetermined and fixed or may be adjustable. In various exemplary embodiments, a particular strobe rate may be chosen based on a desired effect of the strobed light on an individual. For example, a strobing rate may be chosen, which effectively masks tactical movement but is not in a realm that can trigger adverse effects in an individual.

The controller may be programmed to illuminate the light source 152 in a signaling mode. In the signaling mode, the controller controls the light source 152 to emit either visible or non-visible light in a predetermined on/off pattern. In various exemplary embodiments, the signaling pattern may be a standard, preprogrammed pattern, such as, for example, a Morse code pattern. Alternatively, the signaling pattern may be a specific, user-defined pattern.

Visible light and/or non-visible light may be used to provide a signaling pattern. For example, a visible light signaling pattern may be used in a non-covert emergency situation to facilitate the location and/or identification of an individual. Alternatively, a non-visible light signaling pattern may be used to facilitate the location and/or identification of an individual in need of rescue in a covert situation.

It should be appreciated that light signaling patterns may comprise visible light patterns, non-visible light patterns, or a combination of visible and non-visible light patterns.

Light Accessory Controller

Figure 10:
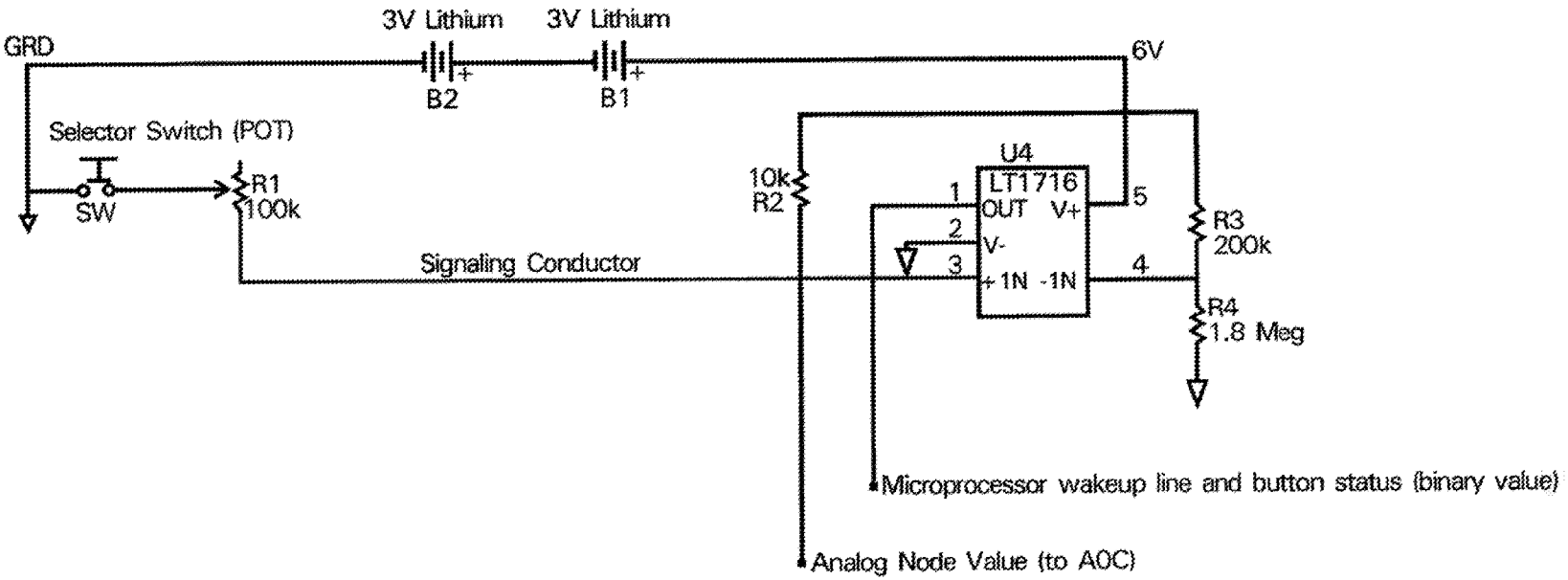
FIG. 10 shows an exemplary schematic diagram that illustrates an exemplary embodiment of an integrated mode selection and activation switch for single conductor implementation, according to this invention.

FIG. 10 shows a schematic diagram that illustrates a nonlimiting, exemplary embodiment of an integrated mode selection and activation switch for single conductor implementation. In various exemplary embodiments, this integrated mode selection and activation switch may be incorporated into the offset mountable light 100. In various exemplary embodiments, the controller may be comprised of at least a portion of the integrated mode selection and activation switch as illustrated in FIG. 10.

Without a specific conductor for every selectable light mode or a complex circuit, the integrated mode selection and activation switch is capable of operating using a normally open momentary switch and a single wire. The integrated mode selection and activation switch needs only to have a ground reference and a signal line to pass resistance (mode) information to the controller.

In various exemplary embodiments, the integrated mode selection and activation switch employs a split voltage divider with a momentary switch (integration of on/off and selection mode). The integrated mode selection and activation switch utilizes a comparator to digitize an analog mode value into binary on/off for controller "wakeup" and ease of reading.

The integrated mode selection and activation switch makes use of electronics and firmware (software) in a microprocessor to reduce mechanical design complexity and cost, particularly in the offset mountable light 100. Thus, the offset mountable light 100 is able to operate using a single conductor to signal a desired operating mode from the light switch bar 120 to the controller, and use a momentary switch as a momentary or latching switch based on press length (or duration of a press of the light switch bar 120) by a user.

The integrated mode selection and activation switch splits a voltage divider (created by R1 and R2 FIG. 10) to opposite sides of a signaling wire (or conductor) to reduce the number of conductors that must go from one portion of the offset mountable light 100 to another portion of the offset mountable light 100. Additionally, the integrated mode selection and activation switch utilizes a comparator to digitize an analog voltage created by the voltage divider to use as a "wakeup line" to the microprocessor such that the microprocessor can "sleep" when not in use, thus extending battery life.

As further shown in FIG. 10, the integrated mode selection and activation switch comprises certain electronic components (i.e., resistors, potentiometer, comparator, ADC, and microprocessor), and a printed circuit board, a momentary switch (normally open). When implemented within, for example, the offset mountable light 100, the integrated mode selection and activation switch may be integrated to operate in conjunction with the light body 112, an optional plastic sleeve (used as an insulator between the outside flashlight body and the inside conductor sleeve), and an optional inside conductor sleeve.

The integrated mode selection and activation switch may serve to reduce the mechanical cost and complexity of the offset mountable light 100. In addition, using this integrated mode selection and activation switch also enables the offset mountable light 100 to make use of a momentary switch to create both momentary switch response and latching switch response.

It should be appreciated that while the integrated mode selection and activation switch is described as being capable of being used in conjunction with the offset mountable light 100, the integrated mode selection and activation switch may be used in flashlights and/or devices other than flashlights. Additionally, various other known or later developed circuits, switches, or configurations may be used in conjunction with the offset mountable light 100.

Adjustable Accessory Mount

FIGS. 1, 2A, 2B, 3A, 3B, 6A, 6B, 7A, and 7B show the adjustable accessory mounting clamp 140 of this invention. As shown in FIGS. 1, 3A, 3B, 7A, and 7B, the adjustable accessory mounting clamp 140 allows the light body 112 to be secured to an accessory mounting rail 128 of an exemplary handgun 180. It should be appreciated that while the offset mountable light 100 is shown as being secured to a handgun 180, the offset mountable light 100 may be mounted or secured to any firearm, tool, accessory, article, or device that includes an appropriate accessory mounting rail.

As illustrated, the adjustable accessory mounting clamp 140 includes at least some of a primary locking arm 141, a secondary locking arm 143, a cam lever 145, a cam lever pin 146, and a threaded adjustment rod 147.

The primary locking arm 141 includes a primary locking claw 142 formed at an upper end of the primary locking arm 141. Likewise, the secondary locking arm 143 includes a secondary locking claw 144 formed at an upper and of the secondary locking arm 143. In various exemplary embodiments, the primary locking arm 141 is maintained in a fixed position relative to the light body 112, while the secondary locking arm 143 is maintained in a pivotable position relative to the light body 112 and the primary locking arm 141.

The threaded adjustment rod 147 is anchored, at a first end, to the primary locking arm 141, extends through an aperture in the secondary locking arm 143, and is threadedly coupled to the cam lever pin 146.

In various exemplary embodiments, the threaded adjustment rod 147 is replaced by a spring (not shown). In these exemplary embodiments, the spring is anchored, at a first end, to the primary locking arm 141, and is coupled to either the secondary locking arm 143 or the cam lever pin 146.

In certain exemplary embodiments, at least one spring (not shown) is positioned around the threaded adjustment rod 147 so as to provide an amount of spring tension to spring bias in the secondary locking arm 143 to an open position.

Figure 6A:
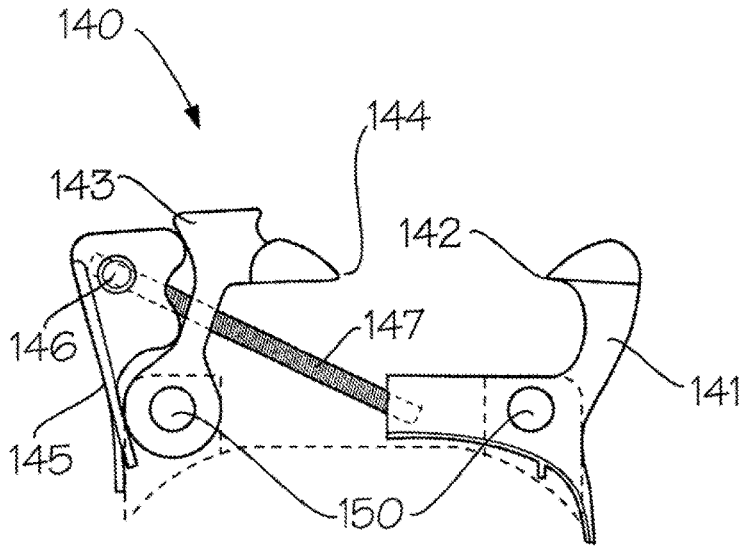
FIG. 6A shows a front elevation view of a first exemplary embodiment of the adjustable accessory mounting clamp according to this invention, wherein the adjustable accessory mounting clamp is illustrated in a closed or locked position.
Figure 6B:
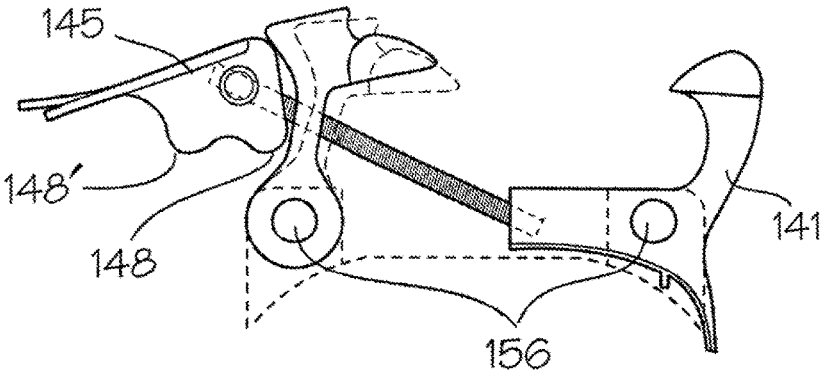
FIG. 6B shows a front elevation view of a first exemplary embodiment of the adjustable accessory mounting clamp according to this invention, wherein the adjustable accessory mounting clamp is illustrated in an opened and a partially opened position.

The cam lever pin 146 is pivotably positioned within the cam lever 145 such that when the cam lever 145 is in an open position (as illustrated in FIG. 6B), the secondary locking claw 144 is pivoted away from the primary locking claw 142. Likewise, when the cam lever 145 is in a close position (as illustrated in FIG. 6A), the secondary locking claw 144 is pivoted towards the primary locking claw 142.

In various exemplary embodiments, the cam lever 145 includes a first caming surface 148 and a second caming surface 148'. In this manner, when the cam lever 145 is in a close position (as illustrated in FIG. 6A), both the first earning surface 148 and a second caming surface 148' independently contact separate outer surface portions of the secondary locking arm 143, place tension on the threaded adjustment rod 147, and work to maintain the adjustable accessory mounting clamp 140 in a closed or clamped position.

When the cam lever 145 is in the open position, the cam lever 145 may be rotated, via the cam lever in 146, so as to travel along the threaded adjustment rod 147. In this manner, the space between the primary locking claw 142 and the secondary locking claw 144 may be adjusted to adjust the tension to accommodate varying width accessory mounting rails, or out of spec or worn rails.

In various exemplary embodiments, the first caming surface 148 and the second caming surface 148' are replaced with a single earning surface (not shown). Alternatively, the cam lever 145 may be provided without any caming surface, such that the cam lever 145 allows for screw adjustment along the threaded adjustment rod 147, but does not provide any means for applying additional tension to the threaded adjustment rod 147 between an open position and a closed position.

In various exemplary embodiments, the adjustable accessory mounting clamp 140 is removably coupled to the light body 112 via clamp attachment pins 149. In these exemplary embodiments, the clamp attachment pins 149 are formed so as to be received within corresponding clamp attachment and receiving apertures 150 formed within the components of the adjustable accessory mounting clamp 140 and the light body 112.

In various exemplary embodiments, the clamp attachment pins 149 may include a threaded portion (not shown) and may be threadedly attached to a portion of the light body 112, the optional heat sink 114, and/or the light hood 116.

While the adjustable accessory mounting clamp 140 is shown as being removably coupled to the light body 112 via clamp attachment pins 149, it should be appreciated that the components of the adjustable accessory mounting clamp 140 may be permanently affixed and/or formed as an integral part of the light body 112.

Figure 3A:
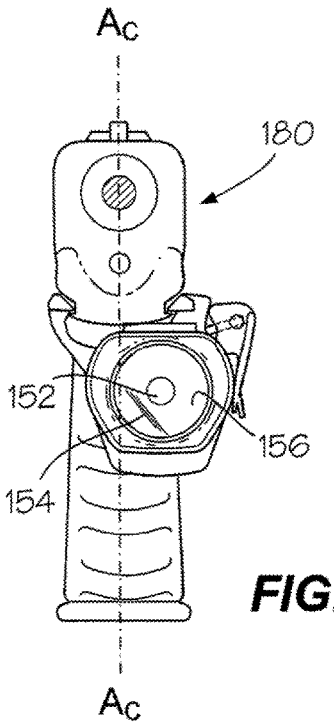
FIG. 3A shows a front elevation view of a first exemplary embodiment of an offset mountable light mounted to a handgun according to this invention, illustrating the mountable light mounted for a left side application.
Figure 3B:
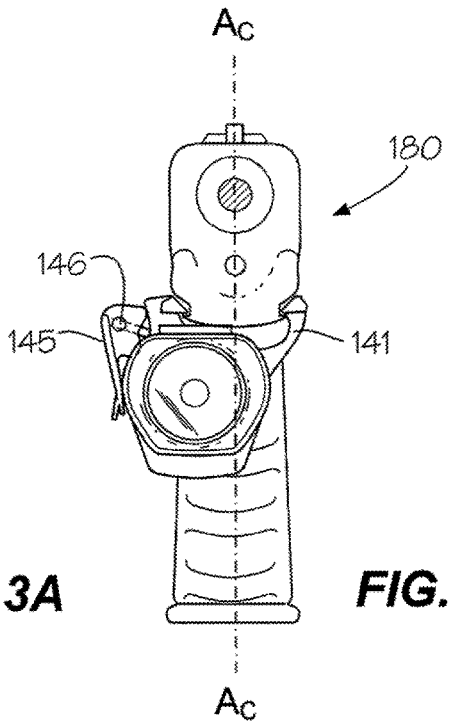
FIG. 3B shows a front elevation view of a first exemplary embodiment of an offset mountable light mounted to a handgun according to this invention, illustrating the mountable light mounted for a right side application.

As shown in FIGS. 2A and 3A the adjustable accessory mounting clamp 140 may be coupled to the light body 112 so as to provide the offset mountable light 100 in a left side orientation. Alternatively, as shown in FIGS. 2B and 3B the adjustable accessory mounting clamp 140 may be coupled to the light body 112 so as to provide the offset mountable light 100 in a right side orientation.

In order to secure the offset mountable light 100 on the accessory mounting rail 182 of the handgun 180, the cam lever 145 of the adjustable accessory mounting clamp 140 is moved to an open position (as illustrated in FIG. 6B). Then, the anti-recoil flange 113 (if included) is aligned with the anti-recoil groove 183 of the handgun 180 and the primary locking claw 142 of the primary locking arm 141 is seated within a corresponding groove of the accessory mounting rail 182.

Next, the secondary locking claw 144 of the secondary locking arm 143 is seated within the remaining corresponding groove of the accessory mounting rail 182. Finally, when the primary locking claw 142 and the secondary locking claw 144 are properly seated within the accessory mounting rail 182 the cam lever 145 is rotated about the cam lever pin 146, to a closed position, thereby shortening the distance between the primary locking claw 142 in the secondary locking claw 144 and securing the adjustable accessory mounting clamp 140 to the accessory mounting rail 182.

As illustrated herein, when the cam lever 145 is rotated to a closed position, the cam lever 145 is held in the closed position by friction between the first caming surfaces and the outer surface portions of the secondary locking arm 143. However, in various exemplary embodiments, when the cam lever 145 is in the closed position, the cam lever 145 may be maintained in the closed position by, for example, being pressed against or into a portion of the light body 112, by being pressed down into a recess, by having a screw, a pin, or a cross-bar inserted or swiveled across the cam lever 145 to maintain the cam lever 145 in the closed position.

As illustrated most clearly in FIGS. 3A and 3B, because of the orientation between the adjustable accessory mounting clamp 140 and the light body 112, when the offset mountable light 100 is secured to the accessory mounting rail 182, the light body 112, the optional heat sink element 114, and in the light hood 116 are not centered along the central bore axis of the handgun 180, but are offset some distance away from the central bore axis of the handgun 180.

By being offset some distance away from the central bore axis of the handgun 180, the offset mountable light 100, when installed on the handgun 180, leaves at least a portion of the trigger guard 185 exposed (a right side portion of the trigger guard 185 if the offset mountable light 100 is mounted in a left side orientation or a left side portion of the trigger guard 185 if the offset mountable light 100 is mounted in a right side orientation) and allows access to at least a portion of the trigger guard 185 of the handgun 180, assists in the right or left hand user orientation, and allows for a lower profile of the handgun and offset mountable light 100 combination.

FIGS. 7A and 7B show a left side elevation view of a first exemplary embodiment of an offset mountable light 100 mounted to an exemplary handgun 180. However, as shown in FIGS. 7A and 7B the switch bar 120 has been replaced by an optional tape switch 170, which extends under the handgun trigger guard 185, according to this invention. As illustrated in FIGS. 7A and 7B, or the optional tape switch 170 includes a pressure-activated switch, or pressure pad 174 that can be depressed to activate the features of the offset mountable light 100, as described above.

It should be appreciated that any known or later developed pressure pad may be used as the pressure pad 174. Thus, the size shape and orientation of the pressure pad 174 is a design choice based upon the desired functionality of the tape switch 170.

The tape switch 170 includes a tape switch coupler 172 that makes appropriate contact with the electrical contacts 160 such that depression of the pressure pad 174 can act to activate the controller to illuminate the light source 152, as described above.

As shown in FIG. 7B, the pressure pad 174 may include an optional attachment means 175 for further securing the pressure pad 174 to the handgun 180.

Retention Holster for an Offset Mounted Accessory

Figure 8A:
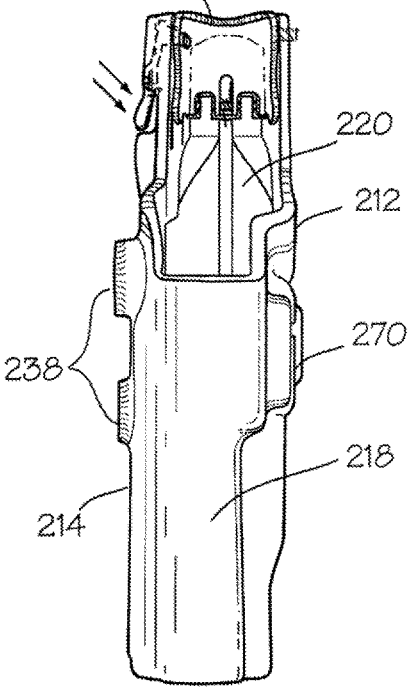
FIG. 8A shows a rear elevation view of a first exemplary embodiment of a retention holster that is capable of accommodating and securing the handgun with the installed light, according to this invention.
Figure 8B:
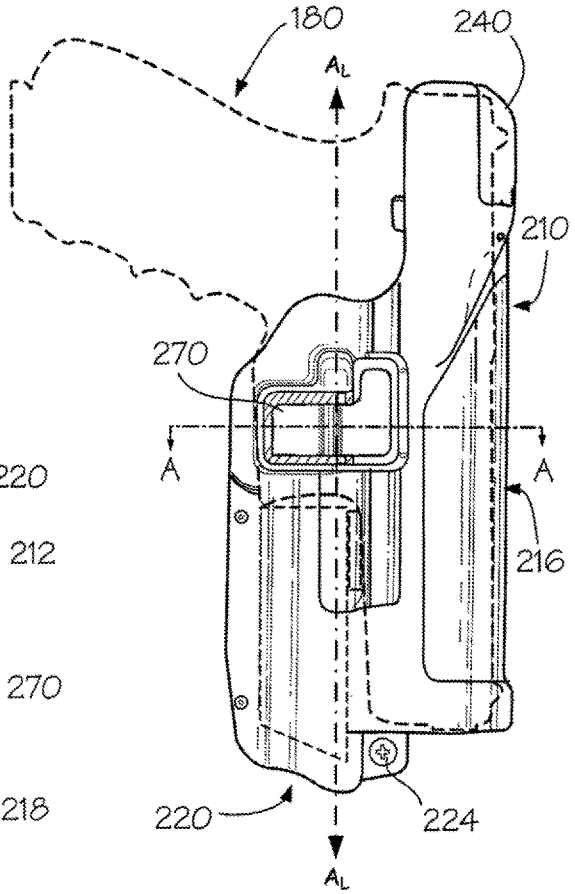
FIG. 8B shows a side elevation view of a first exemplary embodiment of a retention holster that is capable of accommodating and securing the handgun with the installed light, according to this invention.

FIGS. 8A and 8B show a rear elevation view and a side elevation view, respectively, of a first, illustrative, non-limiting embodiment of a retention holster 200 that is capable of accommodating and securing a handgun 180 having an installed offset mounted accessory, such as, for example, an offset mountable light 100.

Figure 9:
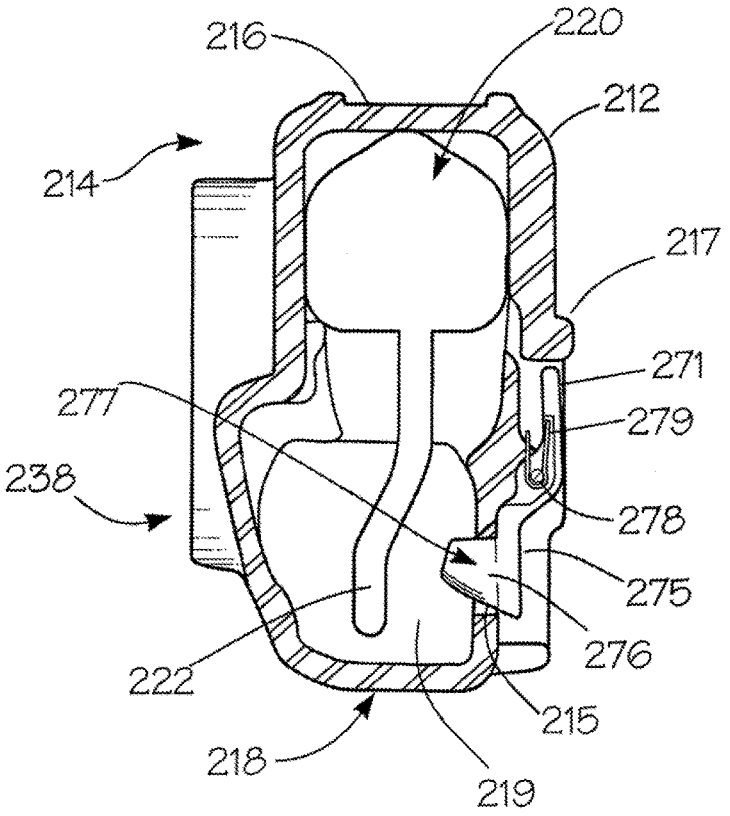
FIG. 9 shows a top cross-sectional view taken along line A-A of the handgun holster of FIG. 8B, illustrating the first exemplary embodiment of the retention system according to this invention in greater detail.

As shown in FIGS. 8A-9, the holster 200 includes a holster body 210 defining a cavity 220 for receiving and holding the handgun. The holster body 210 comprises a pair of opposed side walls comprising a first side wall 212 and a second side wall 214. Typically, the first side wall 212 is considered the outer side of the holster and is worn away from the user's body, while the second side wall 214 is considered the inner side of the holster and is worn against or adjacent the user's body.

The holster body 210 further comprises at least some of a front wall 216, a rear wall 218, and a bottom wall 219. In various exemplary embodiments, the front wall 216, rear wall 218, and bottom wall 219 may comprise extended portions of the first side wall 212 and the second side wall 214.

It should be noted that the walls of the holster 200 are contoured or shaped to accommodate the insertion, retention, and removal of at least one specific type or model of handgun (or other item) with the attached offset mountable light 100.

In various exemplary embodiments, the holster 200 is formed of a polymeric material such as a polymeric composite. Alternate materials of construction may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, and/or various combinations of the foregoing.

Alternatively, at least portions of the holster 200 may be comprised of a flexible or semi-rigid material, such as, for example, a fabric or leather. Thus, it should be understood that the material or materials used to form the holster 200 is a design choice based on the desired appearance and/or functionality of the holster 200.

In various exemplary embodiments, the holster 200 includes attachment points 238, which provide means for fastening the holster to a holster holding device, such as a detachable belt loop. In various exemplary embodiments, the attachment means may comprise screws, rivets, snap-together parts, eyelets, or any other known or later developed means for attaching or coupling the holster holding device to the attachment points 238.

Alternatively, the attachment points 238 and/or the holster holding device may be replaced by another means for fastening the holster. In various exemplary embodiments, the means for fastening the holster may comprise an integrally formed clip, loop, tunnel, or hook adapted to be, for example, clipped over a belt. In further exemplary embodiments, the means for fastening the holster may comprise one or more quick-disconnect or other couplings provided on or adjacent the second side wall 214 of the holster 200, which may be permanently or removably coupled to corresponding and cooperating coupling(s) provided on a belt, carrier, or platform. In still other exemplary embodiments, the holster 200 may comprise an integral belt or one or more connections for attachment to a chest, ankle, leg, shoulder, or other harness or band, or for otherwise securing the holster to a user or the user's apparel.

As further illustrated in FIGS. 8A-9, the holster 200 optionally includes an active retention system. In various exemplary embodiments, the active retention system comprises a lever 270 that is capable of retaining a handgun securely in the holster 200 by including a locking portion that extends inside the cavity 220 and inside the trigger guard 185 of a handgun 180, thereby retaining the handgun 180 in the holster 200 and restricting withdrawal of the handgun 180 from the cavity 220 of the holster 200 until the locking portion of the lever to lever 270 is removed from inside the cavity 220.

In various exemplary, non-limiting embodiments, the active retention system lever 270 comprises the latch device as shown and described in U.S. Pat. No. 5,918,784 entitled Quick-release Handgun Holster, the entire disclosure of which is incorporated herein by reference. In still other exemplary embodiments, the active retention system lever 270 comprises the retention system as shown and described in U.S. patent application Ser. No. 11/030,270 entitled Holster Retention System, the entire disclosure of which is incorporated herein by reference.

As further shown in FIGS. 8A-9, the holster 200 comprises an active retention system that is capable of retaining a handgun securely in the holster 200 by restricting withdrawal of the handgun from the cavity 220 of the holster 200 while permitting a quick release of the handgun when the user requires. The active retention system comprises a lever 270, having a first side facing generally outward from the holster 200, away from the cavity 220, and a second side facing toward the cavity 220. The lever 270 comprises at least some of a finger button end 271 and an engagement end 275.

In various exemplary embodiments, the first side of the finger button end 271 includes a textured portion (not shown). In this manner, the finger button end 271 may be distinguished tactilely from other portions of the lever 270 or the holster 200.

In various exemplary, non-limiting embodiments, lever 270 is pivotally connected to the first side wall 212, approximately between the finger button end 271 and the engagement end 275, via a fulcrum or pivot pin 278. In various exemplary embodiments, the pivot pin 278 is positioned substantially parallel to a vertical axis of the holster 200, substantially perpendicular to a vertical axis of the holster 200, at a substantially acute angle relative to a vertical axis of the holster 200, or at a substantially obtuse angle relative to a vertical axis of the holster 200. Thus, the pivot pin 278 may be positioned at any angle relative to a vertical axis of the holster 200.

The pivot pin 278 may extend all or part of the way across the width of the lever 270.

The lever 270 is pivotable between an engaged position for securing the handgun within the cavity 220 of the holster 200 and a disengaged position for removal of the handgun. In various exemplary embodiments, the lever 270 is biased to an engaged position whether the handgun is present in the holster 200 or absent from the holster 200. The biasing may be accomplished by, for example, a spring means 279.

The engagement end 275 includes a locking portion 276, formed on the second side of the engagement end 275. The locking portion 276 includes a ramp surface 277 and is shaped generally to match the contour of a portion of the inner surface of a handgun's trigger guard. Regardless of the particular handgun used, the locking portion 276 should be shaped so that there is no possibility that the locking portion 276 can at any time contact the trigger of the handgun. When the handgun is pushed as far forward as possible into the holster 200 and the trigger guard has come to rest against the bottom wall 219, there should be a space between the locking portion 276 and the trigger of the handgun.

When the lever 270 is in the engaged position, the locking portion 276 protrudes from the second side of the engagement end 275, into the cavity 220 formed in the holster 200, via an opening 215 in the first side wall 212. In this manner, the locking portion 276 may extend inside the cavity 220 and inside the trigger guard of a handgun that is placed into the holster 200 and, thereby, retain the handgun in the holster 200.

In various exemplary embodiments, the locking portion 276 protrudes into the cavity 220 for a distance that is less than the width of the trigger guard. Alternatively, the locking portion 276 may protrude into the cavity 220 for a distance that is equal to or greater than the width of the trigger guard.

In addition, when the lever 270 is in the engaged position and is retaining a handgun in place, the clearance between the locking portion 276 and the bottom wall 219 should be such that there is room for the slight arc or plunger-type movement of the locking portion 276 when the finger button end 271 is depressed.

Thus, the active retention system is automatically disengaged as the outer surface of the handgun's trigger guard contacts the locking portion 276 and is subsequently engaged when the inner surface of the trigger guard has passed the locking portion 276 and the handgun is appropriately retained in the holster 200.

As at least a portion of each holster 200 is formed to accommodate and securely retain a specific type of handgun and attached, offset accessory. The construction of the holster 200 also prevents the locking portion 276 from contacting the trigger of the inserted handgun by limiting how far the handgun and/or offset accessory can be inserted into the holster 200.

In various exemplary embodiments, a bottom wall 219 is generally formed by a portion of the body of the holster 200. The bottom wall 219 is shaped generally to match the contours of at least a portion of the surface of the muzzle end of the handgun and/or the attached offset accessory. The bottom wall 219 is formed so as to contact at least a portion of the muzzle end of the inserted handgun and/or the attached offset accessory and further limit how far the handgun and/or accessory can be inserted into the holster 200.

The construction of the holster 200 further facilitates alignment of the trigger guard with the locking portion 276 by limiting lateral movement of the handgun and/or the attached offset accessory with respect to the lever 270 and the locking portion 276 without preventing a user from easily holstering or drawing the handgun.

In various exemplary embodiments, a ridge 217 is formed in the first side wall 212 around at least a portion of the lever 270. Generally, the ridge does not contact the lever 270, but provides a perimeter around at least a portion of the lever 270 such that the likelihood of the lever 270 being inadvertently manipulated. The ridge 217 may also include a textured portion (not shown). In this manner, the ridge 217 may be distinguished tactilely from other portions of the holster 200 or the lever 270.

Although FIGS. 8A-9 show the lever 270 connected to the first side wall 212, it should be appreciated that in various exemplary embodiments, the lever 270 may be connected to the second side wall 214.

During use of the holster 200, as a user begins to holster the handgun having the attached offset accessory, the handgun and attached offset accessory are inserted into the cavity 220 of the holster 200, handgun muzzle first, and is guided into position by at least some of the first side wall 212, the second side wall 214, the front wall 216, and the rear wall 218.

As the handgun and attached offset accessory are inserted further into the cavity 220, the outer surface of the trigger guard will contact the ramp surface 277 of the locking portion 276. The shape of the ramp surface 277 allows the locking portion 276 to ride along the surface of the trigger guard and displace the locking portion 276 of the lever 270. As the locking portion 276 rides along the surface of the trigger guard, the bias of the lever 270 is overcome and the lever 270 is pivoted towards the disengaged position and the handgun and attached offset accessory are permitted to be seated in the cavity 220 of the holster. The trigger guard is prevented from moving in a direction opposite the locking portion 276 by the position of the first side wall 212 and the second side wall 214.

As the handgun and attached offset accessory are further seated into the holster 200, the trigger guard continues to displace the locking portion 276 and the lever 270 continues to pivot until the trigger guard passes a point of contact with a farthest extent of the locking portion 276 and clears the locking portion 276. When the trigger guard passes the locking portion 276, the lever 270 will be biased, via the spring means 279, to pivot back to the engaged position.

Thus, the handgun and attached offset accessory are secured in the cavity 220 of the holster 200 by operation of the locking portion 276 blocking removal of the handgun and attached offset accessory, via the inner surface of the trigger guard. While the handgun and attached offset accessory are fully seated in the cavity 220 of the holster 200, with the lever 270 biased to the engaged position, removal of the handgun is not permitted, as the locking portion 276 does not allow the trigger guard to pass by. When the handgun is secured in place, removal force applied to the handgun and/or the attached offset accessory will not remove the handgun or attached offset accessory from the holster 200 unless the finger button end 271 is pivoted and the locking portion 276 is brought out of the way of the inner surface of the trigger guard.

In order to release and unholster the handgun and attached offset accessory, the user must depress the finger button end 271 of the lever 270, pivoting the finger button end 271 towards the cavity 220. At some point, the first side wall 212 will stop the inward movement of the finger button end 271, thus eliminating the possibility that the finger button end 271 can prevent the removal of the handgun and attached offset accessory by contacting the trigger or constricting the trigger guard.

As the bias of the lever 270 is overcome and the finger button end 271 of the lever 270 is depressed, the lever 270 is pivoted towards the disengaged position, and the locking portion 276 of the engagement end 275 is at least partially withdrawn from the opening 215 and out of the holster cavity 220.

When the finger button end 271 has been depressed sufficiently, such that the locking portion 276 of the engagement end 275 is sufficiently withdrawn from the holster cavity 220 and the locking portion 276 clears the inner surface of the trigger guard, the handgun's trigger guard will no longer be blocked by the locking portion 276, and the handgun and attached offset accessory can be withdrawn from the holster 200.

In various exemplary embodiments, the finger button end 271 may be positioned such that, as the finger button end 271 is depressed, the user's index finger is positioned along the frame of the handgun, between the trigger guard and the slide. Therefore, as the handgun and attached offset accessory are withdrawn from the holster 200, the user's index finger is positioned to contact the frame of the handgun, above the trigger guard, and not the trigger guard or the trigger.

The holster 200, as shown and described with reference to FIGS. 8A-9, is oriented such that the first side wall 212 is worn away from the user's body and the second side wall 214 is worn adjacent the user's body, such that the lever 270 is generally accessible by the user's index finger. However, in various other exemplary embodiments, the first side wall 212 is oriented to be worn adjacent the user's body and the second side wall 214 is oriented to be worn away from the user's body. In these exemplary embodiments, the lever 270 is generally accessible by the user's thumb.

As stated above, the offset mountable light 100, when installed on to a handgun, allows access to at least a portion of the handgun's trigger guard. Therefore, the retention holster 200 is capable of utilizing the active retention system lever 270 to secure a handgun 180 having an installed offset mountable light 100.

Because the holster 200 is designed to accommodate a handgun having an attached offset mountable light or other accessory that is offset some distance away from the central bore axis of the handgun, the holster 200 is able to retain the handgun by the at least partially exposed portion of the trigger guard (a right side portion of the trigger guard if the offset mountable light is mounted in a left side orientation or a left side portion of the trigger guard if the offset mountable light is mounted in a right side orientation), is able to be formed for right or left hand orientation, and allows for a lower profile of the holster 200.

As further shown in FIGS. 8A-9, the holster 200 may optionally include a retention guard 240 pivotably coupled to the body 210. The retention guard 240 is pivotable between a closed position for securing the firearm within the cavity 220, as illustrated, for example, in FIG. 8B, and an open position (not shown) for removal of the firearm.

The retention guard 240 comprises the latch retention guard system as shown and described in U.S. patent application Ser. No. 11/350,178 entitled Guarded Holster Having a Guard Release, the entire disclosure of which is incorporated herein by reference. In still other exemplary embodiments, the retention guard 240 comprises the retention guard system as shown and described in U.S. patent application Ser. No. 11/350,130 entitled Retention Holster Having a Guard and Guard Release, the entire disclosure of which is incorporated herein by reference.

However, it should be appreciated that the operating principles of the holster 200 may be implemented in conjunction with additional or other retention means such as, for example, an optional rotating hood, a conventional thumb break, and/or a traditional retention strap.

In various exemplary embodiments, at least a portion of the bottom wall 219 includes an optional slot 222, which define a passive light retention portion. Although not shown in the present figures, the inner surface of the passive retention portion may optionally include one or more raised or textured areas, which provide for additional frictional engagement between the inner surface of the passive retention portion and at least a portion of the offset mountable light 100 (i.e., the light hood 116). One or more tension screws 224 may be tightened or loosened to adjust the degree of frictional retention of the portion of the offset mountable light 100 by the passive retention portion.

The passive retention portion, if included, may be adjusted, via the one or more tension screws 224, to provide an adjustable frictional tension between the passive retention portion and the portion of the offset mountable light 100, without increasing the frictional tension between a remaining portion of the holster 200 and the handgun 180.

While this invention has been described in conjunction with the exemplary embodiments outlined above, it is evident that many alternatives, modifications, and variations will be apparent to those skilled in the art.

For example, while the adjustable accessory mounting clamp 140 has been shown and described as being used in conjunction with an offset mountable light, it should be appreciated that the elements of the adjustable accessory mounting clamp may be employed to mount any desired accessory on a dovetail type mounting rail.

Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A holster for receiving and releasably retaining a handgun and an accessory attached to the handgun, the accessory being offset in a latitudinal direction from a barrel bore axis of the handgun, the holster comprising:

a holster body extending from a substantially open top portion to a bottom portion and defining a cavity, wherein a longitudinal axis of the holster extends generally from the open top portion to the bottom portion, the cavity including a frame/slide receiving portion and an accessory receiving portion, the frame/slide receiving portion sized to receive a slide of the handgun and the accessory receiving portion being dimensioned to receive the accessory, wherein the accessory receiving portion is offset in the latitudinal direction relative to the frame/slide receiving portion;

a lever, wherein said lever includes a first side facing generally outward from said cavity and a second side facing generally toward said cavity, wherein said lever is pivotally attached to a first side wall of said holster;

the lever having a locking portion extending from a surface of said second side of said lever, wherein said lever is pivotable between an engaged position and a disengaged position and wherein said lever is biased to said engaged position, and wherein, when said lever is in said engaged position, said locking portion protrudes through an opening in said first side wall, into said cavity, such that said locking portion extends into said cavity.

2. The holster of claim 1, wherein said cavity includes a frame/slide portion and a trigger guard portion.

3. The holster of claim 1, wherein a depth of said frame/slide portion is different from a depth of said trigger guard portion.

4. The holster of claim 1 wherein further comprising a retention guard positioned above the slide/frame cavity portion, the retention guard movable between a blocking position and a non-blocking position with respect to the handgun.

5. A holster for receiving a handgun with an accessory mounted to a rail of the handgun, the accessory laterally offset from an axis of the rail, the holster comprising:

a holster body extending from a substantially open top portion to a bottom portion and the holster body defining a cavity having a forward frame/slide cavity portion for receiving a frame/slide portion, and a lower cavity portion for receiving the accessory and, wherein a longitudinal axis of said holster extends generally from said open top portion to said bottom portion;

a finger button for releasing the handgun movably connected with respect to the holster body, the finger button facing generally outward;

a trigger guard locking portion operably connected to the finger button, the locking portion movable between an engaged position and a disengaged position with the handgun when the handgun is in the holster by way of depressing the finger button;

wherein the lower portion of the cavity is offset in a latitudinal direction from said longitudinal axis of said holster.

6. The holster of claim 4, wherein said walls of said holster are contoured to accommodate a specific type or model of handgun and accessory to be retained within said holster.

7. The holster of claim 5, further comprising one or more slots, wherein said slots define a passive retention portion for providing frictional retention of an accessory to be retained within said holster.

8. The holster of claim 5, further comprising a retention guard positioned above the slide/frame cavity portion, the retention guard movable between a blocking position and a non-blocking position with respect to the handgun.

9. The holster of claim 8, wherein the release of the retention guard may is by a user's thumb.

10. The holster of claim 5, wherein the release of the trigger guard locking portion is by a finger.

11. The holster of claim 5, wherein trigger guard locking portion has an engagement end that includes a ramp surface configured such that, as said handgun is inserted into said cavity of said holster, said trigger guard will contact said ramp surface and displace said engagement end in a direction away from said trigger guard until a point at which said ramp surface is no longer in contact with said trigger guard, whereupon said engagement end will move in a direction toward said trigger guard and secure said handgun in said holster.

12. The holster of claim 5, wherein said finger button is part of a lever and the lever is biased, via a spring, to said engaged position.

13. The holster of claim 12, wherein said lever is pivotally attached, via a pivot pin.

14. The holster of claim 5, wherein said finger button end is uncovered.

15. A holster comprising:

a holster body extending from a substantially open top portion to a bottom portion and defining at least a partial cavity for receiving a handgun and an optionally attached accessory, wherein a longitudinal axis of said holster extends generally from said open top portion to said bottom portion, wherein said cavity includes a frame/slide portion and an accessory portion, and wherein said accessory portion is offset in a latitudinal direction from said longitudinal axis;

a pivot pin supported by the holster body, the pivot pin being disposed atop a first side wall of the holster body at location outside of the cavity;

a lever pivotally supported by the pivot pin, the pivot pin extending through the lever at a location between a finger button end and an engagement end; and a locking portion connecting to a finger button, with the locking portion movable between an engaged position and a disengaged position, wherein said locking portion is biased to said engaged position, and wherein, when said locking portion is in said engaged position, said locking portion interferes with the withdrawal of the handgun by way of a trigger guard of the handgun.

16. The holster of claim 1 in combination with the handgun and the accessory attached to the handgun.

17. The holster of claim 5 in combination with the handgun and the accessory attached to the handgun.

* * * * *